United States Patent [19]

Wallner

[11] 4,261,768

[45] Apr. 14, 1981

[54] LOW ALLOYED STEEL HAVING IMPROVED CORROSION BEHAVIOR, IN PARTICULAR RELATIVE TO SEA WATER

[75] Inventor: Felix Wallner, Linz, Austria

[73] Assignee: Voest-Alpine Aktiengesellschaft, Linz, Austria

[21] Appl. No.: 52,497

[22] Filed: Jun. 27, 1979

Related U.S. Application Data

[60] Continuation of Ser. No. 859,725, Dec. 12, 1977, abandoned, which is a division of Ser. No. 692,890, Jun. 4, 1976, abandoned.

[51] Int. Cl.[3] ..... C22C 38/20; C22C 38/24; C22C 38/26; C22C 38/28

[52] U.S. Cl. ..... 148/36; 75/124; 75/125; 75/126 D; 75/126 E; 75/126 F; 75/128 G; 75/128 T; 75/128 V; 203/11; 203/86

[58] Field of Search ..... 75/124, 125, 126 B, 75/126 F, 126 D, 126 E, 128 A, 128 G, 128 T, 128 V; 148/36; 202/267 R; 203/10, 11, 86

[56] References Cited

U.S. PATENT DOCUMENTS

| | | | |
|---|---|---|---|
| 2,968,549 | 1/1961 | Brady et al. | 75/126 F |
| 3,044,872 | 7/1962 | Hayes et al. | 75/126 F |
| 3,257,200 | 6/1966 | Hodge | 148/36 |
| 3,531,279 | 9/1970 | Baerlecken | 75/128 G |
| 3,783,040 | 1/1974 | Ballance et al. | 148/36 |
| 3,834,897 | 9/1974 | Nevalainen | 75/126 F |
| 3,899,368 | 8/1975 | Waid et al. | 148/36 |

FOREIGN PATENT DOCUMENTS

| | | | |
|---|---|---|---|
| 40-8130 | 4/1965 | Japan . | |
| 46-22327 | 6/1971 | Japan | 75/126 D |

OTHER PUBLICATIONS

Translation of Japanese Patent No. 22327/1971 published on 6/25/71, Translation by Lindner Translations, Inc.

*Nachschlgewerk Stahlschlussel* 10th edition No. 194, p. 84 (1974).

Önorm (Austrian Standard) M3115 pp. 1 to 4 (1975).

*Primary Examiner*—Michael L. Lewis

*Attorney, Agent, or Firm*—Brumbaugh, Graves, Donohue & Raymond

[57] ABSTRACT

A low alloyed structural steel for desalination plants with improved corrosion behavior has a carbon content of between 0.01 and 0.15 percent, a chromium content of between 2.0 and 4.5 percent and a columbium content of between 0.1 and 1.0 percent, and if desired, contents of copper, nickel and manganese totalling maximally 2.5 percent, and contents of fine grain formers totalling maximally 0.2 percent, balance iron and impurities due to melting.

7 Claims, No Drawings

LOW ALLOYED STEEL HAVING IMPROVED CORROSION BEHAVIOR, IN PARTICULAR RELATIVE TO SEA WATER

This is a continuation of application Ser. No. 859,725 filed Dec. 12, 1977 which was a divisional of application Ser. No. 692,890 filed June 4, 1976, both abandoned.

BACKGROUND OF THE INVENTION

The invention relates to a low-alloyed structural steel for desalination plants having improved corrosion behaviour, especially with respect to sea water and a method of making it.

Unalloyed steels corrode to different degrees when subjected to sea water, brackish water, polluted fresh water, the atmosphere and the soils in the area of such waters, depending on the concentration, the pH-value, the gas content (in particular the oxygen content), the flow rate and the temperature of the aggressive media. For this reason construction parts and structures of unalloyed steels, such as ships and other marine structures, are protected against corrosion by a coating.

Often, however, technical and economical considerations do not permit corrosion protection by coating, or they require a corrosion-inhibiting behaviour from the base material in event of damage to the coating.

The influence of corrosion can impair the safety and functioning of a structure (e.g. by reducing the supporting cross section, by cracks, leaks and the like). In certain cases of application the amount of the corrosion products formed can also negatively affect the functioning of a structure, e.g. the clogging of heat exchanger tubes and pipes in sea water desalination plants or cooling systems.

Therefore, a material in contact with corroding media ought to have an improved behaviour against plane corrosion as well as against local corrosion.

As is known, the inherent corrosion protection of steels is caused by the formation of a more or less dense protective layer on the surface. In high alloyed corrosion and acid resistant steels, this protective layer consists of a thin, but very dense, adhering layer of metal oxide that is largely resistant to chemical media, the so-called "passive" layer. Low alloyed steels can also be protected against atmospheric corrosion by forming covering layers, which, however, cannot be compared with a passive layer. These comparatively thick, but increasingly dense covering layers are formed by initial corrosion in the course of numerous wet and dry periods and consist mainly of water-insoluble crystallized corrosion products. Although these layers are not as dense as closed oxide layers, they still prevent or reduce, the admission of oxygen to the surface of the steel. With these low alloyed steels which are known as weather-proof structural steels the possibility of forming a protective layer is largely lost when the steel is constantly immersed in water or the protective effect of the covering layer is largely lost when the aggressive media contains chlorine.

For the last mentioned corrosion conditions, high alloyed steels that form a passive layer, have been the only materials hitherto available. But for economical reasons it is not always possible to use them. On the other hand, the contents of the passivating alloying elements required is so high that the production and processing of such steels is limited.

SUMMARY OF THE INVENTION

The invention aims at providing a low alloyed structural steel for desalination plants having improved corrosion resistance and, in particular, localized corrosion resistance, whose strength and workability meet the same demands made of structural steel, and whose production costs, however, are far below those of high alloyed steels forming a passive layer.

According to the invention, this object is achieved by a combination of alloying elements which, due to their affinity for oxygen, can form stable oxides and covering layers and which can also form nearly insoluble complexes with chlorine compounds.

The steel of the invention is characterized by a carbon content of between 0.01 and 0.15% by weight; a chromium content of between 2.0 and 4.5% by weight; a columbium content of between 0.1 and 1.0% by weight; if desired, copper, nickel and manganese contents, the total amount of which does not exceed 2.5% by weight; as well as, if desired, contents of fine grain formers such as aluminum, titanium and vanadium, the total amount of which does not exceed 0.2% by weight; balance iron and impurities due to melting. Here all the contents of the alloying elements are below the passivating limit. It was found that the chromium content in the steel of the invention, whose upper limit (4.5%) is far below the limit for complete chromium passivation (13.5% chromium), causes the excellent resistance of the steels of the invention to plane corrosion, but raising the limit beyond 4.5% does not lead to further improvement. Such a steel—it was found—would, however, be very prone to localized corrosion without a content of columbium. According to the invention, this proneness to localized corrosion is inhibited by the additional columbium content. The copper content has the same kind of effect; i.e., it has been shown that the effect of the chromium-columbium-combination can be improved by the addition of copper.

Thus, a preferred composition of steel consists in that the steel has a carbon content of between 0.01 and 0.1% by weight, a chromium content of between 3.0 and 4.0% by weight, a columbium content of between 0.5 and 1.0% by weight, a copper content of between 0.5 and 1.0% by weight, a manganese content of between 0.3 and 0.6% by weight and an aluminum content of between 0.02 and 0.1% by weight.

For reasons of production and with a view to a further improvement of the corrosion resistance, an additional nickel content is advantageous, which content ought to amount to at least half the copper content.

According to a further preferred embodiment, the steel of the invention contains fine grain formers, such as aluminum, titanium and vanadium, in amounts of between 0.02 and 0.2% by weight titanium and/or between 0.05 and 0.15% by weight vanadium and/or between 0.02 and 0.1% by weight aluminum, but totalling not more than 0.2% by weight.

Preferably the steel has a sulphur content of maximumly 0.017% by weight and a phosphorus content of maximumly 0.015% by weight.

DESCRIPTION OF EXEMPLARY EMBODIMENTS

The following Table 1 gives three steel compositions I, II, III, which in tests have proved to be corrosion resistant.

TABLE 1

| Steel | No. | C | Si | Mn | P | S | Al | Cr | Ni | Cu | Nb |
|---|---|---|---|---|---|---|---|---|---|---|---|
| I | 391 | 0.057 | 0.28 | 0.50 | 0.015 | 0.017 | 0.031 | 3.10 | 0.5 | 0.98 | 0.64% |
| II | 411 | 0.07 | 0.30 | 0.49 | 0.011 | 0.013 | 0.040 | 3.04 | — | 0.52 | 0.32% |
| III | 381 | 0.07 | 0.26 | 0.47 | 0.013 | 0.017 | 0.048 | 3.15 | — | — | 0.33% |

The mechanical properties of these steels after normalizing are the following:

| Steel | $\sigma_{0.2}$ kp/rm$^2$ | $\sigma_B$ | $d_5$ % |
|---|---|---|---|
| I | 45.6 | 62.1 | 28.6 |
| II | 26.0 | 46.9 | 37.3 |
| III | 30.3 | 49.8 | 36.0 |

The following Tables 2, 3, 4 and 5 illustrate the corrosion behaviour of steels I, II, III in detail as compared to a soft, unalloyed control steel of the St 37-type (i.e. a steel having 0.20% max C, 0.05% max P, 0.05% max S.

Table 2 relates to dynamic corrosion tests in steels I, II and III in the laboratory in artificial sea water (produced according to ASTM D 1141), whose temperature was 75° C. at one time and 115° C. at another time. The oxygen content of the sea water was also varied: it was 40 ppb in one case and 500 ppb (1 ppb=1 part per billion=0.0000001%) in the other case. The pH-value was 7.4 in both test series and the water rate was 2 and 2.5 m/sec, respectively. The erosion is measured in mg/dm$^2$ day.

TABLE 2

Dynamic corrosion in artificial sea water.

| | Steel 75° C./14 ppb $O_2$/pH = 7.4/2 m/s | 115° C./500ppb $O_2$pH 7.4/2.5 m/s |
|---|---|---|
| | erosion in mg/dm$^2$ day | |
| I | 2 | 70 |
| II | 2 | 70 |
| III | 8 | 100 |
| unalloyed control steel | 35 | 300 |

Table 3 shows the corrosion behaviour relative to agitated natural sea water. For 90% of the tests carried out over a period of 2.5 months a pH-value of 7.5 was used, and for 10% a pH-value of 4.2 was used (flushing of the test sheets and plates with acidic water). The tests were carried out at three temperatures, i.e. 35° C., 76° C. and 114° C., and with different oxygen contents, i.e. 150 ppb, 25 ppb and 15 ppb. The numerical values represent the erosion in mg/dm$^2$ day.

TABLE 3

Dynamic corrosion in natural sea water, 2.5 months, pH-value 7.5 (90%); 4.2 (10%); erosion values in mg/dm$^2$ day.

| Steel | 35° C./150 ppb | 70° C./25 ppb | 114° C./15 ppb |
|---|---|---|---|
| I | 65 | 120 | 140 |
| II | 50 | 120 | 170 |
| unalloyed control steel | 100 | 250 | 300 |

Table 4 represents the corrosion behaviour of steels I, II and III in still, artificial and natural sea water having different oxygen contents. Here, too, the tests were carried out by varying time, temperature and oxygen concentration.

TABLE 4

Statical corrosion in artificial and natural sea water. Erosion values in mg/dm$^2$ day.

| Steel | artificial $100^h$/75° C./100 ppb | natural $2000^h$/75° C./50 ppb |
|---|---|---|
| I | 3 | 5 |
| II | 4 | 4 |
| III | 4 | 5 |
| unalloyed control steel | 10 | 25 |

In Table 5 the corrosion behaviour of steels I, II and III under free weather exposure an industrial atmosphere is represented and compared to the unalloyed control steel.

TABLE 5

Free weather exposure in industrial atmosphere - exposure 250 days.

| Steel | Erosion in mg/dm$^2$ day |
|---|---|
| I | 7 |
| II | 7 |
| III | 9 |
| unalloyed control steel | 25 |

The results indicate that the steels according to the invention have a substantially higher corrosion resistance as compared to unalloyed structural steel, and under the roughest conditions, e.g., under the influence of hot acrated sea water their resistance is three to ten times better than that of an unalloyed steel. Still, the steel of the invention can be processed just like unalloyed structural steel. The production costs made according to a steel of the invention costs of a steel made according to the invention are not higher than about twice the costs of unalloyed structural steel and substantially lower than those of high alloyed steels.

The steels of the invention can be subjected to heat-treatment in a common manner. They are especially well suited for use as working material for sea water desalination plants operating according to the flash distillation process in the asrolled, normalized, annealed or quenched and tempered condition. In such plants the temperatures of the sea water (brine) to be evaporated ranges between 35° and 120° C. and the oxygen contents of the brine in the different flash chambers are between 20 and 500 ppb.

With the steels of the invention it is possible not only to make the flash chambers and water containers hitherto made of common structural steel much more durable and resistant, but also to replace the high alloyed chromium nickel steels.

What I claim is:

1. A structural member of sea water desalination plants that operate according to the flash distillation process, which member comes into contact with sea water, said member being made of a low alloyed steel and being at least three to ten times more resistant than St 37-type steel to the static and dynamic corrosion of aerated sea water ranging in temperature up to 115° C., which steel consists of:

0.01 to 0.1 percent carbon;
3.0 to 4.0 percent chromium;
0.5 to 1.0 percent columbium;
0.5 to 1.0 percent copper;
0.3 to 0.6 percent manganese;
optionally nickel in an amount such that the total content of copper, nickel and manganese is maximally 2.5 percent taken all together;
0.02 to 0.1 percent aluminum;
optionally titanium and vanadium in an amount such that the total content of aluminum, titanium and vanadium is maximally 0.2 percent taken all together; and
balance iron and incidental silicon impurities, all of which alloying elements being below the passivating limit.

2. A structural member as set forth in claim 1, further including nickel in an amount corresponding to at least half the copper content.

3. A structural member as set forth in claim 1, further including at least one element selected from the group consisting of titanium in an amount ranging between 0.02 and 0.2 percent, vanadium in an amount ranging between 0.05 and 0.15 percent and aluminum in an amount ranging between 0.02 and 0.1 percent.

4. A structural member as set forth in claim 1 being in the as rolled condition in sea water desalination plants.

5. A structural member as set forth in claim 1 being in the normalized condition in sea water desalination plants.

6. A structural member as set forth in claim 1 being in the quenched and tempered condition in sea water desalination plants.

7. A structural member of sea water desalination plants that operate according to the flash distillation process, which member comes into contact with sea water, said member being made of a low alloyed steel and being at least three to ten times more resistant than St 37-type steel to the static and dynamic corrosion of aerated sea water ranging in temperature up to 115° C., which steel consists of:
0.01 to 0.1 percent carbon;
3.0 to 4.0 percent chromium;
0.5 to 1.0 percent columbium;
0.5 to 1.0 percent copper;
0.3 to 0.6 percent manganese;
optionally nickel in an amount such that the total content of copper, nickel and manganese is maximally 2.5 percent taken all together;
0.02 to 0.1 percent alumimum;
optionally titanium and vanadium in an amount such that the total content of aluminum, titanium and vanadium is maximally 0.2 percent taken all together;
0.0 to 0.017 percent sulphur;
0.0 to 0.015 percent phosphorous; and
balance iron and incidental silicon impurities, all of which alloying elements being below the passivating limit.

* * * * *

UNITED STATES PATENT AND TRADEMARK OFFICE

CERTIFICATE OF CORRECTION

PATENT NO. : 4,261,768

DATED : April 14, 1981

INVENTOR(S) : Felix Wallner

It is certified that error appears in the above—identified patent and that said Letters Patent is hereby corrected as shown below:

Col. 3, line 4, "0.011" (under heading "P") should read --0.014--; line 15, "kp/rm$^2$" should read --kp/mm$^2$--; line 18, "30.3" should read --30.7--; line 36, "C./14" should read --C./40--; line 37, "$O_2$pH" should read --$O_2$/pH = --.

Col. 4, line 20, after "exposure" insert --in--; line 24, after "in" insert --an--; line 37, "acrated" should read --aerated--; lines 40 & 41, delete "costs made according to a steel of the invention"; line 47, "working material" should read --structural members--.

Col. 5, lines 24 & 25, delete "and aluminum in an amount ranging between 0.02 and 0.1 percent".

Col. 6, line 20, "alumimum" should read --aluminum--.

Signed and Sealed this

*Twenty-first* Day of *July 1981*

[SEAL]

*Attest:*

GERALD J. MOSSINGHOFF

*Attesting Officer*

*Commissioner of Patents and Trademarks*